US007089966B2

(12) United States Patent
Casarotto

(10) Patent No.: US 7,089,966 B2
(45) Date of Patent: Aug. 15, 2006

(54) ASSEMBLY FOR ACTUATING THE WEAVING MECHANISM FOR WEAVING LOOMS

(75) Inventor: Giuseppe Casarotto, Bergamo (IT)

(73) Assignee: Promatech S.p.A., Colzate (IT)

( * ) Notice: Subject to any disclaimer, the term of this patent is extended or adjusted under 35 U.S.C. 154(b) by 71 days.

(21) Appl. No.: 10/496,095

(22) PCT Filed: Nov. 15, 2002

(86) PCT No.: PCT/EP02/12843

§ 371 (c)(1),
(2), (4) Date: May 20, 2004

(87) PCT Pub. No.: WO03/044254

PCT Pub. Date: May 30, 2003

(65) Prior Publication Data

US 2005/0016611 A1 Jan. 27, 2005

(30) Foreign Application Priority Data

Nov. 20, 2001 (EP) ..... 01830717

(51) Int. Cl.
*D03D 51/00* (2006.01)

(52) U.S. Cl. ..... 139/1 E

(58) Field of Classification Search ..... 139/1 E, 139/1 R, 55.1, 11, 116.2
See application file for complete search history.

(56) References Cited

U.S. PATENT DOCUMENTS

| | | | | |
|---|---|---|---|---|
| 3,557,841 | A * | 1/1971 | Moessinger | 139/1 E |
| 4,424,835 | A * | 1/1984 | Wagenmakers | 139/1 E |
| 4,874,018 | A * | 10/1989 | Van Bogaert et al. | 139/1 E |
| 5,522,434 | A | 6/1996 | Lindblom | |

FOREIGN PATENT DOCUMENTS

| | | |
|---|---|---|
| DE | 195 35 333 | 3/1997 |
| EP | 1 096 048 | 5/2001 |

* cited by examiner

*Primary Examiner*—John J. Calvert
*Assistant Examiner*—Andrew W. Sutton
(74) *Attorney, Agent, or Firm*—Young & Thompson

(57) ABSTRACT

An actuating assembly for a weaving loom includes at least a first motor for actuating the weaving mechanism with a dual power take-off, the two power take-off points being connected to two opposite sections of a main drive shaft able to move devices for actuating the weaving mechanism which are located respectively on the two sides of the loom.

20 Claims, 3 Drawing Sheets

ASSEMBLY FOR ACTUATING THE WEAVING MECHANISM FOR WEAVING LOOMS

The present invention relates to an assembly for actuating the weaving mechanism for a weaving loom, in particular a direct-drive actuating assembly.

BACKGROUND ART

As is known, conventionally mechanical actuation of a weaving loom is performed by means of a main motor connected to a main shaft of the loom. The term "main shaft" is therefore understood as meaning the shaft which provides the motion to the main weaving components of the loom, such as the sley and reed, the grippers or the weft insertion nozzles, other devices such as the weft supply device, cutters, tensioners and, finally, the weave machine as well.

Normally the weave machine can be engaged with and disengaged from the main shaft and a secondary motor is also envisaged, said motor being connected to the weave machine by a respective coupling device and which is used to find the pick and move the whole loom in a slow running condition. Precisely in order to satisfy this requirement, it is known to use a coupling system comprising clutch, brake and flywheel between the main motor and the weaving mechanism and the weave machine.

It has also been proposed to simplify considerably this basic structure, by eliminating the secondary motor and the main coupling device with the associated flywheel.

A known device is, for example, that described in European patent application No. 01112634.9, in which it is taught to use a single motor connected, via a continuous drive, to the weave machine and able to drive, by means of an engageable and disengageable transmission, the other weaving components of the loom as well.

These solutions, however, have certain drawbacks. In particular, the dimensions of these actuating assemblies are considerable and occupy their own position on the loom which cannot be used in any other way. Moreover, the provision of the coupling devices involves design, manufacture and maintenance costs.

Moreover, the actuating assembly is normally located on one of the two sides of the loom and therefore imputs torques at one end only: this means that the torque moments which are generated on the transmission members of the loom, especially if the latter is fairly high, are considerable. This characteristic is such that the transmission shafts which extend over the whole height of the loom (for example the sley-actuating cam shaft) must be designed with appropriate dimensions and suitably supported, i.e. it is required to use large sections (=more material and greater weight) and a plurality of supports which-interfere with the other components of the loom.

Moreover, the angular deformations and strains of these shafts produce angular offsets of the ends of the shafts and result in abnormal displacements of the weaving components actuated by these shafts. For example, the torsional force acting on the cam shaft actuating the sley may result in a difference of displacement between the two ends of the reed which as a result does not move perfectly perpendicularly with respect to the warp yarns, causing inevitable weaving defects.

The object of the present invention is to provide an arrangement of the assembly for actuating the weaving mechanism which overcomes the drawbacks described above.

In particular, it is provided to simplify the series of components forming the loom actuating mechanism in order to reduce the inertial phenomena (thus increasing, among other things, the rapidity of response during the start-up and stoppage transients); ensure the symmetry of the general structural lay-out, in particular the resistive and applied loads, so as to optimise the structural response of the loom to the dynamic actions; and reduce the dimensions and the structural complexity, so as to achieve also savings in terms of costs.

SUMMARY OF THE INVENTION

The abovementioned objects are achieved by means of an actuating assembly, the main features of which are described in the accompanying main claims.

Other aspects of the invention are highlighted in the secondary claims.

The loom according to the invention is provided with two actuating systems which are mechanically independent, but coordinated during operation, respectively for the weaving mechanism and for the weave machine. Each actuating system comprises an independent motor controlled by a control unit which manages the whole loom. In particular, the synchronized operation of the two motors is controlled via an electric axis. If necessary a mechanical safety device (not shown in the drawings for the sake of clarity) is present and able to intervene in the event of a malfunction in order to prevent under all circumstances that desynchronisation between weaving mechanism and weave machine exceeds a value considered dangerous, so as to avoid damaging the (woven) article and/or the machine. The separate division of the drive systems between the two systems (weaving mechanism and weave machine) is also combined with a favourable modification of the structural lay-out of the loom: the main motor connected to the weaving mechanism, according to the invention is arranged centrally in the loom, so as to distribute the torque equally on either side of the loom and actuate in a uniform and balanced manner both the cam follower system for the motion of the sley and the pairs of weft insertion mechanisms (for example the pairs of grippers).

According to an advantageous feature of the invention, the main motor is connected via a direct drive to the weaving mechanism by means of the main shaft, eliminating the need for an electromechanical coupling device and any associated gear trains. This advantageous result arises from the fact that there no longer exists the need to actuate both the weaving mechanism and the weave machine using the same motor, which would instead require a facility for disengaging the transmission.

According to this advantageous embodiment, a second independent motor is provided, said motor being assigned exclusively to the actuation of the weave machine, and is connected via an electric axis to the first motor.

According to a preferred embodiment, the first motor is integrated with the main shaft (motor-driven shaft), the latter coinciding with the axis of rotation of the said motor.

BRIEF DESCRIPTION OF THE DRAWINGS

Further characteristic features and advantages of the present invention will nevertheless emerge more clearly from the detailed description which follows, considered together with the accompanying drawings, in which.

DESCRIPTION OF THE PREFERRED EMBODIMENTS

Figure 1:
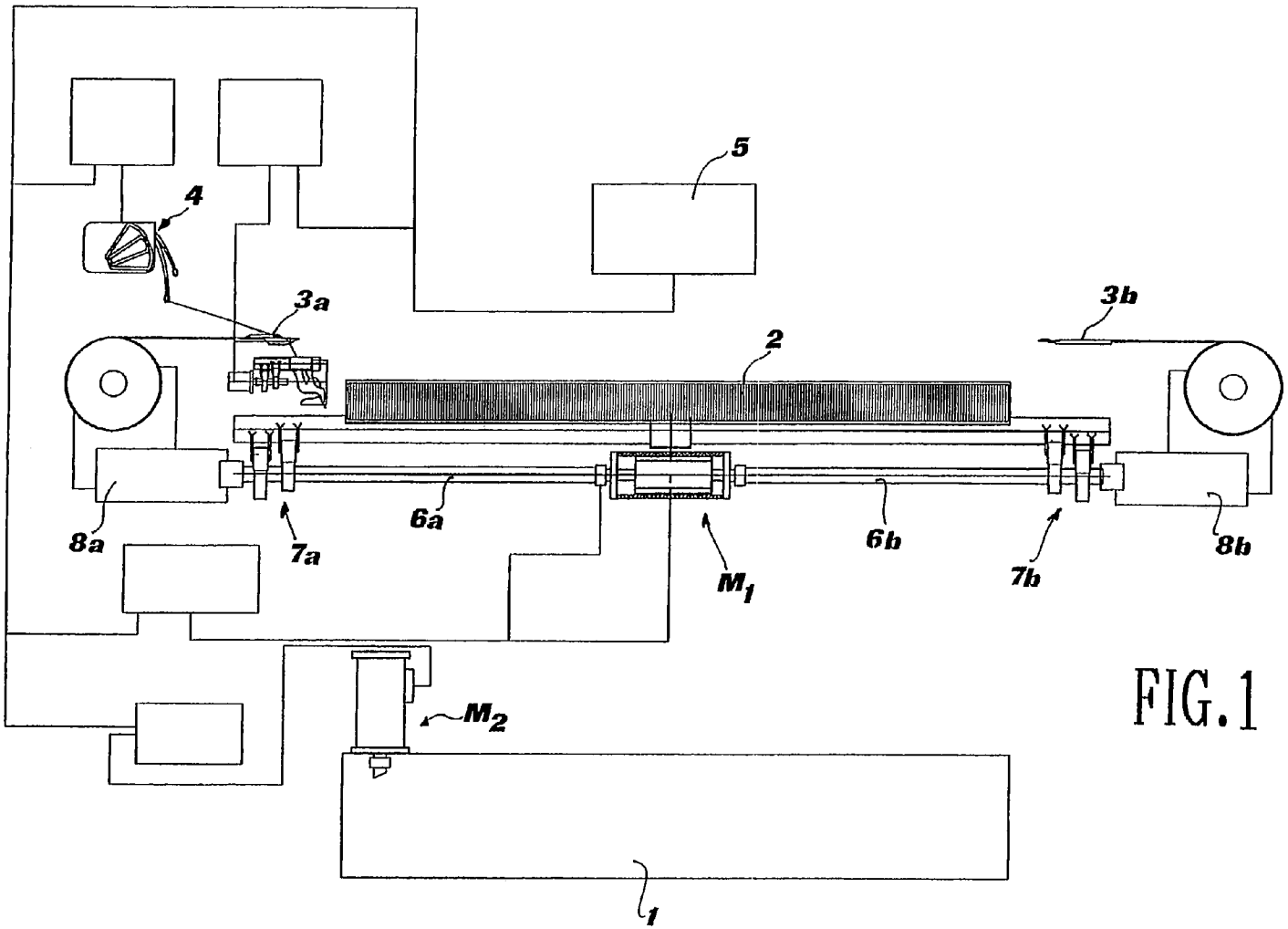
FIG. 1 is a schematic view of the main mechanical components of a gripper loom with a logical diagram of the interdependent connections.

As shown in FIG. 1, a gripper loom comprises a weave machine 1 which interacts with the transverse movement of the warp yarns and therefore produces the weave of the fabric which is formed, and a weaving mechanism comprising, depending on the situation, a sley 2, a pair of weft insertion grippers 3*a*–3*b*, and other accessory equipments, such as the supply device 4, cutters (not shown) and other components.

According to one embodiment of the invention, the weaving mechanism and the weave machine are operated by two independent actuating motors, $M_1$ and $M_2$ respectively.

These two motors are also joined together via an electric axis by a control unit 5 which, suitably programmed, manages operation of the whole loom. It must be pointed out, in this connection, that the control unit 5 has the function of keeping synchronised, in accordance with a specific loom operating program, the two motors $M_1$ and $M_2$ not only during normal operation, but also in anomalous or transient conditions (start-up and stoppage, finding of the pick, slow forwards and reverse running, etc.). Sensing of the position of the two motors $M_1$ and $M_2$ is performed by means of (angular) position transducers, preferably absolute-reference encoders, such that correct synchronism between the two motors may be restored also after a stoppage followed by a movement of only one of the two motors.

Figure 2:
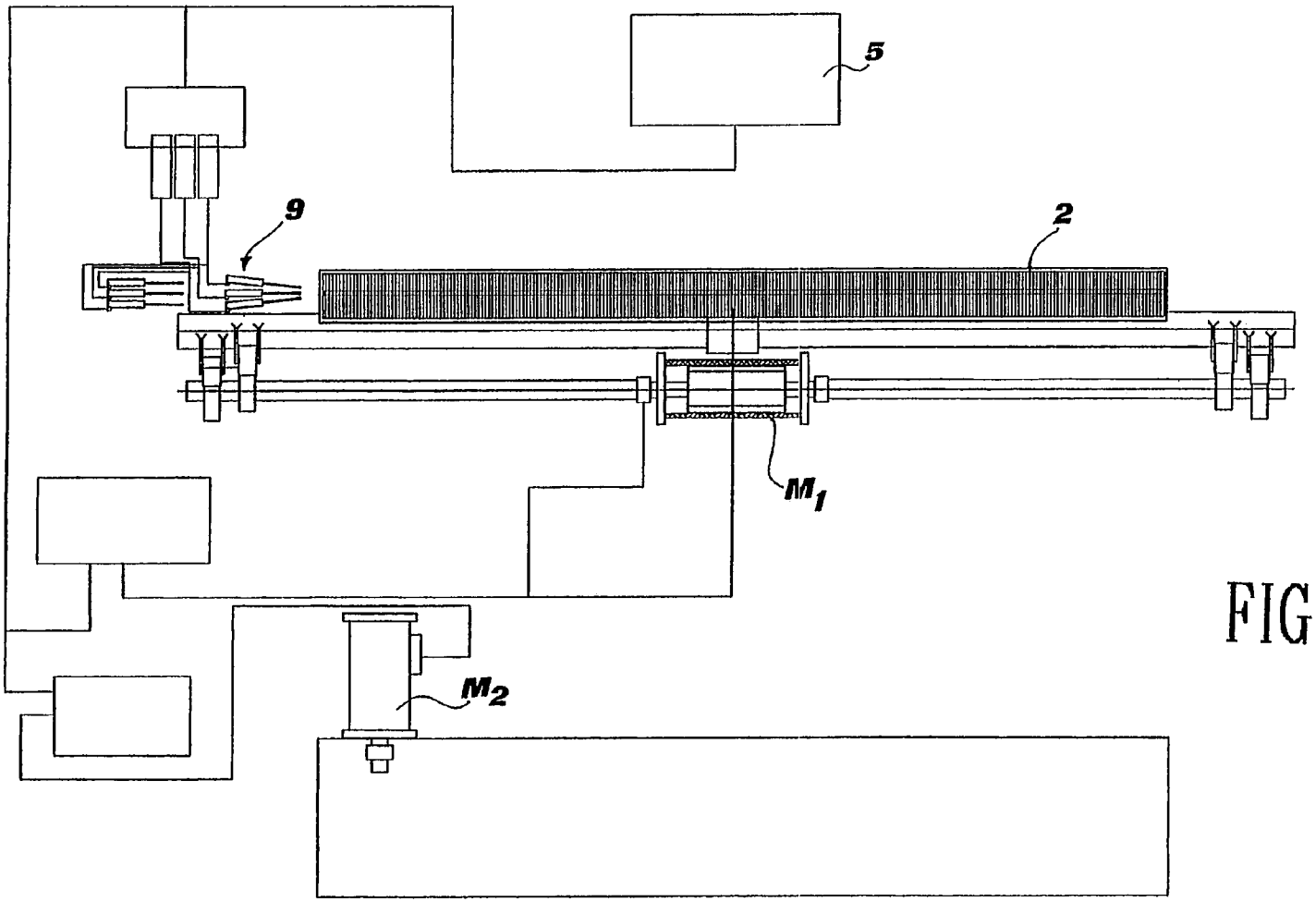
FIG. 2 is a view, similar to that of FIG. 1, with reference to an air loom.

According to a preferred embodiment of the invention, moreover, the main motor $M_1$ is arranged in a substantially symmetrical position on the loom, as clearly illustrated in FIGS. 1 and 2. The motor $M_1$, in particular, has two opposite power take-off points from where two opposite sections 6*a* and 6*b* of a main shaft of the loom depart.

The outer or distal ends of the two shaft sections 6*a* and 6*b* also have, fixed to them, the main loads of the weaving mechanism, for example cam/follower devices 7*a* and 7*b* for actuating the two ends of the sley 2, as well as devices 8*a* and 8*b* for moving the pair of grippers 3*a* and 3*b*.

Figure 3:
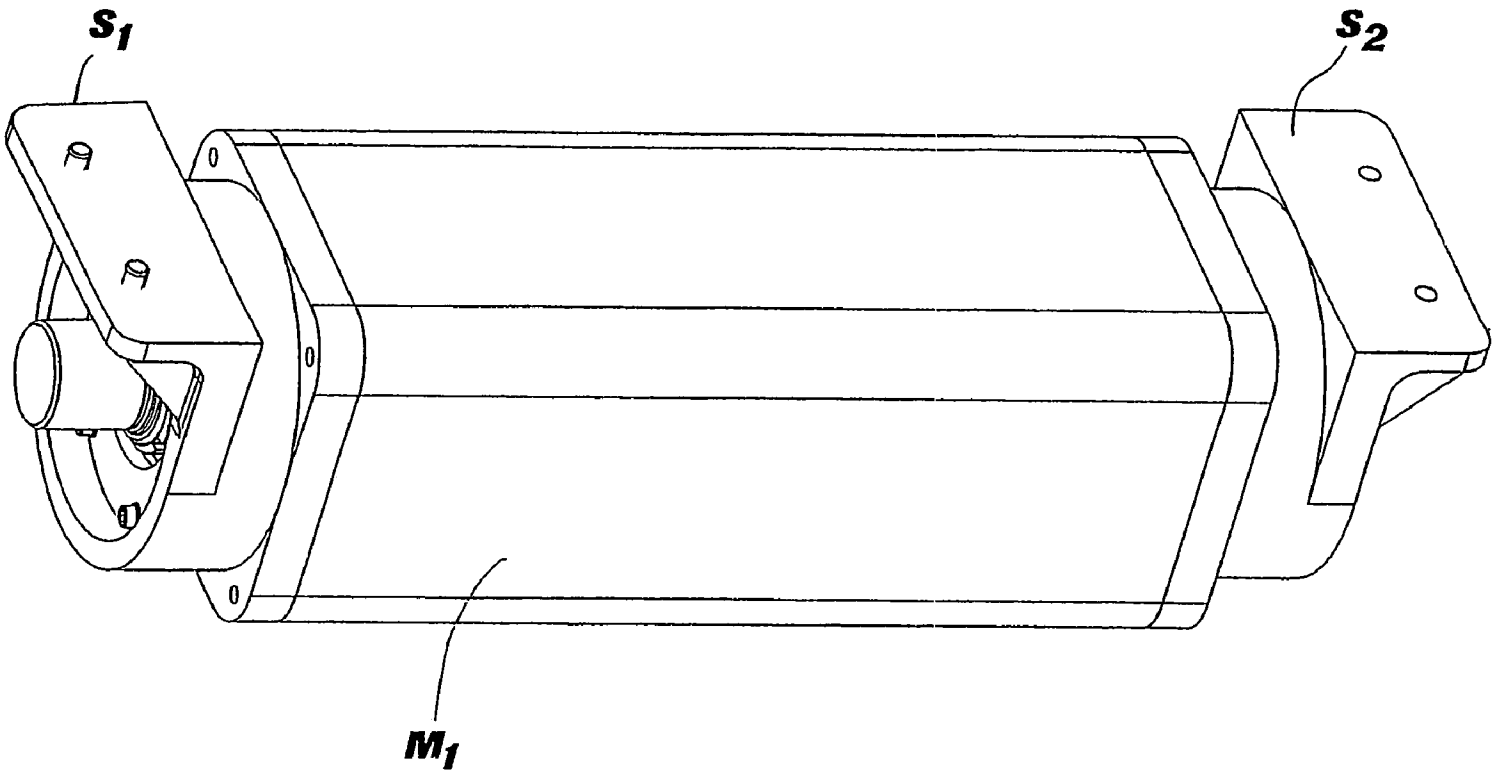
FIG. 3 is a perspective view of the main motor used in the middle of the loom according to the invention.

In the figures, the motor $M_1$ is arranged in a central position on the cross-piece supporting the sley (not shown) by means of suitable fixing brackets $S_1$ and $S_2$ (FIG. 3). Said motor is equipped with bearings supports of suitable size for supporting the two sections 6*a* and 6*b* of the main drive motor.

The sections 6*a* and 6*b* of the main shaft have a variable length depending on the height of the loom and are connected to said motor by means of any mechanical joint of the known type.

The system formed by the shaft and by the supports must be able to withstand the torsional and flexural loads imparted by the torque of the main motor and by the resistive loads; moreover, this system must not be subject to elastic instability phenomena.

The motor is provided internally with a motor-driven shaft having a suitable torsional rigidity and based preferably on "brushless" but also variable reluctance or asynchronous technology.

The motor-driven shaft may terminate at a short distance from the ends of the motor or may comprise at least a portion of the opposite sections of the drive shaft. The length of the motor also depends on the torque to be generated and the permissible transverse dimension which, as can be understood, must be as small as possible.

FIG. 2 shows an air loom which comprises a main motor $M_1$ suitably designed for transferring the necessary torque to the main shaft actuating the sley 2. The control unit 5 has the function of co-ordinating via an electric axis the two motors $M_1$ and $M_2$ as well as the air nozzle device 10 for insertion of the weft yarns.

Such a layout has numerous advantages and allows the objects described in the preamble to be achieved.

In fact, the singular distribution of the loads between the two motors and the elimination of the reducer, electromagnetic coupling, clutch brake and flywheel constitute an advantage from the point of view of simplification and costs.

Moreover, the barycentric (with reference to the resistive loads) location of the main shaft motor permits a drastic reduction in the maximum torque moments at the ends of the loom, with a notable advantage in terms of the stresses applied. This allows, as a result, to use lighter shafts and a reduction, compared to the prior art, in the number of supports and bearings, thus reducing the inertial phenomena of the machine. The bearings of the engine are able to perform advantageously also the function of bench supports for the output shaft. On a loom of relatively small height it is likely that the supports of the two sections of the main drive shaft be provided exclusively at the ends, the centre being supported by the same bearings of the motor-driven shaft $M_1$ which transmits the stresses to the loom via the supports $S_1$ and $S_2$.

Finally, the symmetrical distribution of the loads between the two sections of the main drive shaft helps improve the energetic efficiency of the machine, ensure uniform beating-up of the fabric and equalise the weft conveying and exchange operations performed by the two grippers.

With the motor in a barycentric position with respect to the loads, equivalent stresses, and hence strains, are achieved at the two ends of the loom: this also allows the sley to be controlled in a perfectly uniform manner, without irregular displacements being imparted to its two ends, therefore resulting in correct operation devoid of weaving defects.

From a constructional point of view, in fact, as a result of the central position of the motor, the elastic deformation energy U of each shaft section projecting from the motor $M_1$ may be reduced drastically, resulting in a more rigid transmission:

$$U=\tfrac{1}{2}T2\ l/(JG)$$

where U=elastic deformation energy; T=torque; l=length of the shaft section; J=polar moment of inertia; G =transverse elasticity modulus.

The central position of the motor results in a reduction in the angle of elastic torsion of the two sections of the actuating shaft—compared to a configuration where the motor is positioned on one side—and theoretically zero relative angular offset between the two actuating devices (which is otherwise notably present, according to the prior art, in particular during the start-up transients), helping ensure that the sley remains parallel to the beam and to the weft, in particular during the start-up and stoppage transients, therefore reducing the weaving defects upon stoppages.

It is understood, however, that the invention is not limited to the particular configurations illustrated above, which form only non-limiting examples of the scope of the invention, but that numerous modifications are possible, all within the competence of a person skilled in the art, without thereby departing from the scope of the invention itself.

The invention claimed is:

1. Actuating assembly for a weaving loom, comprising at least a first motor for actuating the weaving mechanism, characterized in that said first motor is of the type comprising a dual power take-off, the two power take-off points being connected to two opposite sections of a main drive shaft apt to move devices for actuating said weaving mechanism which are present respectively on the two sides of the loom.

2. Actuating assembly as claimed in claim 1, in which said main motor is arranged on the loom in a substantially barycentric position with respect to the main associated resistive loads.

3. Actuating assembly as claimed in claim 1, in which said main motor is arranged at the axis of transverse symmetry of the loom.

4. Actuating assembly as claimed in claim 3, in which said motor is mounted by means of support brackets on a cross-member of said loom and a pair of bearings of the motor have a support function also for said opposite sections of the main drive shaft.

5. Actuating assembly as claimed in claim 4, in which said opposite sections of the drive shaft are supported only at the ends.

6. Actuating assembly as claimed in claim 1, in which said first motor is in the form of a motor-driven shaft with two power take-off points.

7. Actuating assembly as claimed in claim 6, in which said power take-off points are connected to the proximal ends of the two opposite sections of said main drive shaft, said two sections being also connected at the respective distal ends at least to the devices for actuating the sley.

8. Actuating assembly as claimed in claim 7, in which said sections of the main shaft are also connected at their distal ends to respective devices for moving a pair of grippers for insertion of the weft yarn.

9. Actuating assembly as claimed in claim 7, in which said sections of the main shaft are also connected to other weaving devices.

10. Actuating assembly as claimed in claim 1, in which said first motor is connected via an electric axis to a second separate motor for actuating a weave machine.

11. Actuating assembly as claimed in claim 1, in which said first motor is connected via a direct drive to said sections of the main drive shaft.

12. Actuating assembly as claimed in claim 2, in which said main motor is arranged at the axis of transverse symmetry of the loom.

13. Actuating assembly as claimed in claim 8, in which said sections of the main shaft are also connected to other weaving devices.

14. Actuating assembly for a weaving loom, comprising:

a first motor with two opposite power take-off points;

two opposite shaft sections of a main drive shaft, each shaft section connected to one of the two power takeoff points;

two main loads of a weaving mechanism, each main load fixed to a distal end of each of the two shaft sections; and a device for moving a gripper fixed to the distal end of each of the two shaft sections.

15. The assembly of claim 14, wherein, each main load is a cam/follower device for actuating one of two ends of a sley.

16. The assembly of claim 14, further comprising:

a second motor connected to a machine driving heddle frames.

17. The assembly of claim 15, further comprising:

a second motor connected to a machine driving heddle frames.

18. Actuating assembly for a weaving loom, comprising:

a first motor with two opposite power take-off points;

two opposite shaft sections of a main drive shaft, each shaft section connected to one of the two power take-off points;

two main loads of a weaving mechanism, each main load fixed to a distal end of each of the two shaft sections; and a second motor connected to a machine driving heddle frames.

19. The assembly of claim 18, wherein, each main load is a cam/follower device for actuating one of two ends of a sley; and further comprising a device for moving a gripper fixed to the distal end of each of the two shaft sections.

20. The assembly of claim 1, further comprising:

a second motor driving heddle frames, the second motor being free of any mechanical connection to the first motor.

* * * * *